US008712784B2

(12) United States Patent
Seo et al.

(10) Patent No.: US 8,712,784 B2
(45) Date of Patent: Apr. 29, 2014

(54) ENCODING METHOD AND ENCODING DEVICE, DECODING METHOD AND DECODING DEVICE AND TRANSCODING METHOD AND TRANSCODER FOR MULTI-OBJECT AUDIO SIGNALS

(75) Inventors: Jeong Il Seo, Daejeon (KR); Kyeong Ok Kang, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 148 days.

(21) Appl. No.: 13/377,334

(22) PCT Filed: Jun. 10, 2010

(86) PCT No.: PCT/KR2010/003752

§ 371 (c)(1),
(2), (4) Date: Dec. 9, 2011

(87) PCT Pub. No.: WO2010/143907

PCT Pub. Date: Dec. 16, 2010

(65) Prior Publication Data

US 2012/0078642 A1 Mar. 29, 2012

(30) Foreign Application Priority Data

Jun. 10, 2009 (KR) ..... 10-2009-0051378
Jun. 23, 2009 (KR) ..... 10-2009-0055756
Jun. 7, 2010 (KR) ..... 10-2010-0053549

(51) Int. Cl.
*G10L 19/00* (2013.01)

(52) U.S. Cl.
USPC ..... 704/500

(58) Field of Classification Search
CPC ..... G10L 19/08
USPC ..... 704/500
See application file for complete search history.

(56) References Cited

U.S. PATENT DOCUMENTS

2009/0125314 A1 5/2009 Hellmuth et al.
2010/0228554 A1 9/2010 Beack et al.

FOREIGN PATENT DOCUMENTS

KR 1020090040857 A 4/2009
WO 2009049895 A1 4/2009

OTHER PUBLICATIONS

Jonas Engdegard, Spatial Audio Object Coding (SAOC)—The Upcoming MPEG Standard on Parametric Object Based Audio Coding, The 124th Audio Engineering Society Convention Paper, May 17, 2008.

Jurgen Herre, New Concepts in Parametric Coding of Spatial Audio: From SAC to SAOC, Multimedia and Expo, 2007 IEEE International Conference on. Jul. 2, 2007. pp. 1894-1897.

Leonid Terentiev et al., Clarifications regarding the enhanced Karaoke/Solo processing mode, ISO/IEC JTC1/SC29/WG11, Apr. 2009, pp. 1-4, Maui, Hawaii, USA.

Yang-Won Jung et al., Comments on the enhanced karaoke mode in SAOC, ISO/IEC JTC1/SC29/WG11, Feb. 2009, Lausanne, CH.

*Primary Examiner* — Jakieda Jackson
(74) *Attorney, Agent, or Firm* — NSIP Law

(57) ABSTRACT

A method of encoding a multi-object audio signal and an encoding apparatus, a decoding method and a decoding apparatus, and a transcoding method and a transcoder are provided. A multi-object audio signal encoding apparatus may encode object signals obtained by excluding ForeGround Objects (FGOs) from a plurality of input object signals, and may encode the FGOs, thereby providing a listener with a satisfactory sound quality.

20 Claims, 6 Drawing Sheets

ENCODING METHOD AND ENCODING DEVICE, DECODING METHOD AND DECODING DEVICE AND TRANSCODING METHOD AND TRANSCODER FOR MULTI-OBJECT AUDIO SIGNALS

TECHNICAL FIELD

The present invention relates to a method of encoding a multi-object audio signal and an encoding apparatus, a decoding method and a decoding apparatus, and a transcoding method and a transcoder. More particularly, the present invention relates to methods and apparatuses for encoding, decoding and transcoding a multi-object audio signal using a spatial parameter.

BACKGROUND ART

Recently, a Spatial Audio Object Codec (SAOC) scheme is used to compress a multi-object audio signal. Generally, when the SAOC scheme is used, a plurality of input object signals may be compressed using only a spatial parameter of audio object signals that are input for each frequency band, and a sound scene may be generated. Accordingly, a sound scene where a volume is controlled for each object signal may be generated even at an extremely low bit rate. However, since the multi-object audio signal is compressed and restored using only a limited amount of bits, a sound quality of object signals may be inevitably degraded during encoding and decoding. In particular, in an environment where a specific object signal such as a vocal signal is completely removed or is independently played back, the sound quality may be seriously degraded. Accordingly, in the SAOC scheme, a range for controlling object signals is generally limited.

For example, when the SAOC scheme is used to encode and decode object signals that are desired to be controlled to an extreme level and that are, hereinafter, referred to as ForeGround Objects (FGOs) among a plurality of input object signals, and to extremely control the FGOs, the sound quality may be rapidly degraded. Here, FGOs may include vocal signals and thus, a karaoke service may be implemented using the vocal signals.

Accordingly, there is a desire for an audio signal encoding technology that may prevent a degradation in a sound quality even in an extremely controlled environment, while controlling a volume for each object signal, thereby providing listeners with a satisfactory sound quality.

DISCLOSURE OF INVENTION

Technical Goals

An aspect of the present invention provides methods and apparatuses for encoding and decoding a multi-object audio signal, and a transcoding method and a transcoder that may control a volume of ForeGround Objects (FGOs) such as vocal signals, and a volume of BackGround Objects (BGOs) including signals other than the FGOs for each object signal, to provide a service such as a Karaoke service.

Another aspect of the present invention provides methods and apparatuses for encoding and decoding a multi-object audio signal, and a transcoding method and a transcoder that may encode and decode FGOs together with BGOs, and may increase a number of object signals to be controlled.

Still another aspect of the present invention provides methods and apparatuses for encoding and decoding a multi-object audio signal, and a transcoding method and a transcoder that may control a volume of FGOs and a volume of BGOs for each object signal, thereby preventing a degradation in a sound quality even in an extremely controlled environment.

Technical Solutions

According to an aspect of the present invention, there is provided an encoding apparatus, including: a first encoder to downmix object signals, and to generate BackGround Objects (BGOs) and a Spatial Audio Object Codec (SAOC) parameter, the object signals being obtained by excluding ForeGround Objects (FGOs) from a plurality of input object signals; and a second encoder to downmix the FGOs and the BGOs, and to generate a final downmix signal and an Enhanced Karaoke-Solo (EKS) parameter.

The encoding apparatus may further include a multiplexer to multiplex the SAOC parameter and the EKS parameter and to generate an SAOC bitstream.

The first encoder and the second encoder may be operated selectively based on an EKS encoding mode for controlling the FGOs, and a classic encoding mode for controlling the BGOs.

According to another aspect of the present invention, there is provided an encoding method, including: downmixing object signals, and generating BackGround Objects (BGOs) and a Spatial Audio Object Codec (SAOC) parameter, the object signals being obtained by excluding ForeGround Objects (FGOs) from a plurality of input object signals; and downmixing the FGOs and the BGOs, and generating a final downmix signal and an Enhanced Karaoke-Solo (EKS) parameter.

The encoding method may further include multiplexing the SAOC parameter and the EKS parameter, and generating an SAOC bitstream.

According to still another aspect of the present invention, there is provided a decoding apparatus, including: a bitstream analyzer to extract a Spatial Audio Object Codec (SAOC) parameter and an Enhanced Karaoke-Solo (EKS) parameter from a multiplexed SAOC bitstream; a first decoder to restore ForeGround Objects (FGOs) and BackGround Objects (BGOs) from a final downmix signal using the EKS parameter; a second decoder to generate a first rendered signal from the BGOs using the SAOC parameter and a rendering matrix; and a renderer to generate a final rendered signal using the FGOs and the first rendered signal.

The renderer may generate, based on the rendering matrix, the final rendered signal by using the first rendered signal and a second rendered signal that is generated from the FGOs.

The first decoder may include a downmix preprocessor to preprocess the BGOs based on the rendering matrix, and to generate a modified downmix signal, an SAOC transcoder to convert the SAOC parameter into a Moving Pictures Experts Group Surround (MPS) bitstream based on the rendering matrix, and an MPS decoder to render the modified downmix signal based on the MPS bitstream and to generate the first rendered signal.

The renderer may generate the final rendered signal using the rendered modified downmix signal and the FGOs.

The first decoder and the second decoder may be operated selectively based on an EKS decoding mode for controlling the FGOs, and a classic decoding mode for controlling the BGOs.

The first decoder may render the restored FGOs based on the rendering matrix. The renderer may combine the rendered FGOs and the rendered BGOs, and may generate the final rendered signal.

According to a further aspect of the present invention, there is provided a decoding method, including: extracting a Spatial Audio Object Codec (SAOC) parameter and an Enhanced Karaoke-Solo (EKS) parameter from a multiplexed SAOC bitstream; restoring ForeGround Objects (FGOs) and BackGround Objects (BGOs) from a final downmix signal using the EKS parameter; generating a first rendered signal from the BGOs using the SAOC parameter and a rendering matrix; and generating a final rendered signal using the FGOs and the first rendered signal.

The generating of the final rendered signal may include generating, based on the rendering matrix, the final rendered signal by using the first rendered signal and a second rendered signal that is generated from the FGOs.

The generating of the first rendered signal may include preprocessing the BGOs based on the rendering matrix, and generating a modified downmix signal, converting the SAOC parameter into a Moving Pictures Experts Group Surround (MPS) bitstream based on the rendering matrix, and rendering the modified downmix signal based on the MPS bitstream and generating the first rendered signal.

The generating of the final rendered signal may include generating the final rendered signal using the rendered modified downmix signal and the FGOs.

The decoding method may further include rendering the restored FGOs based on the rendering matrix. The generating of the final rendered signal may include combining the rendered FGOs and the rendered BGOs, and generating the final rendered signal.

According to a further aspect of the present invention, there is provided a decoding apparatus, including: a bitstream analyzer to extract a Spatial Audio Object Codec (SAOC) parameter and an Enhanced Karaoke-Solo (EKS) parameter from a multiplexed SAOC bitstream; a first decoder to restore ForeGround Objects (FGOs) and BackGround Objects (BGOs) from a final downmix signal using the EKS parameter, and to render the restored FGOs based on a rendering matrix; a second decoder to render the BGOs using the SAOC parameter and the rendering matrix; and a renderer to combine the rendered FGOs and the rendered BGOs, and to generate a final rendered signal.

According to a further aspect of the present invention, there is provided a decoding method, including: extracting a Spatial Audio Object Codec (SAOC) parameter and an Enhanced Karaoke-Solo (EKS) parameter from a multiplexed SAOC bitstream; restoring ForeGround Objects (FGOs) and BackGround Objects (BGOs) from a final downmix signal using the EKS parameter; rendering the restored FGOs based on a rendering matrix; rendering the BGOs using the SAOC parameter and the rendering matrix; and combining the rendered FGOs and the rendered BGOs and generating a final rendered signal.

Effect

According to embodiments of the present invention, it is possible to control a volume of ForeGround Objects (FGOs) such as Karaoke signals, and a volume of BackGround Objects (BGOs) for each object signal.

Additionally, according to embodiments of the present invention, it is possible to encode and decode FGOs together with BGOs, and to increase a number of object signals to be controlled.

Furthermore, according to embodiments of the present invention, it is possible to control a volume of FGOs and a volume of BGOs for each object signal, thereby preventing a degradation in a sound quality even in an extremely controlled environment.

BEST MODE FOR CARRYING OUT THE INVENTION

Figure 1:
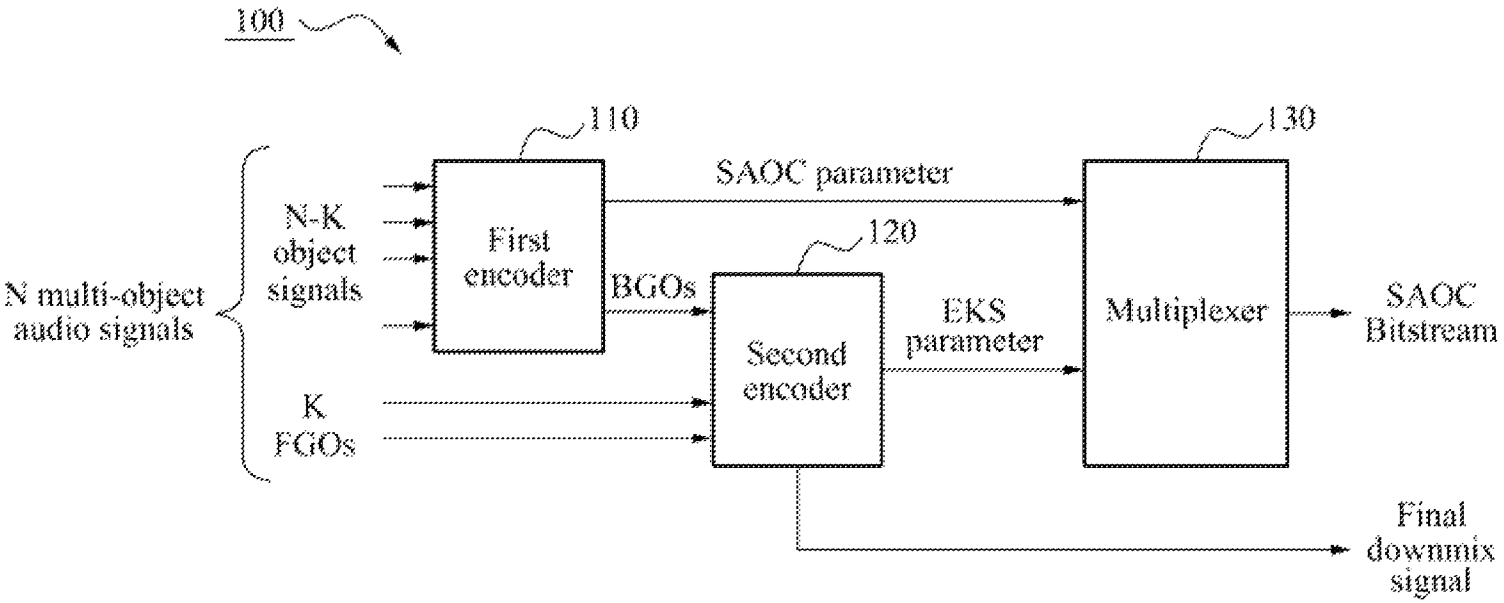
FIG. 1 is a diagram illustrating a configuration of a multi-object audio signal encoding apparatus according to an embodiment of the present invention.

Reference will now be made in detail to embodiments of the present invention, examples of which are illustrated in the accompanying drawings, wherein like reference numerals refer to the like elements throughout. The embodiments are described below in order to explain the present invention by referring to the figures.

Figure 2:
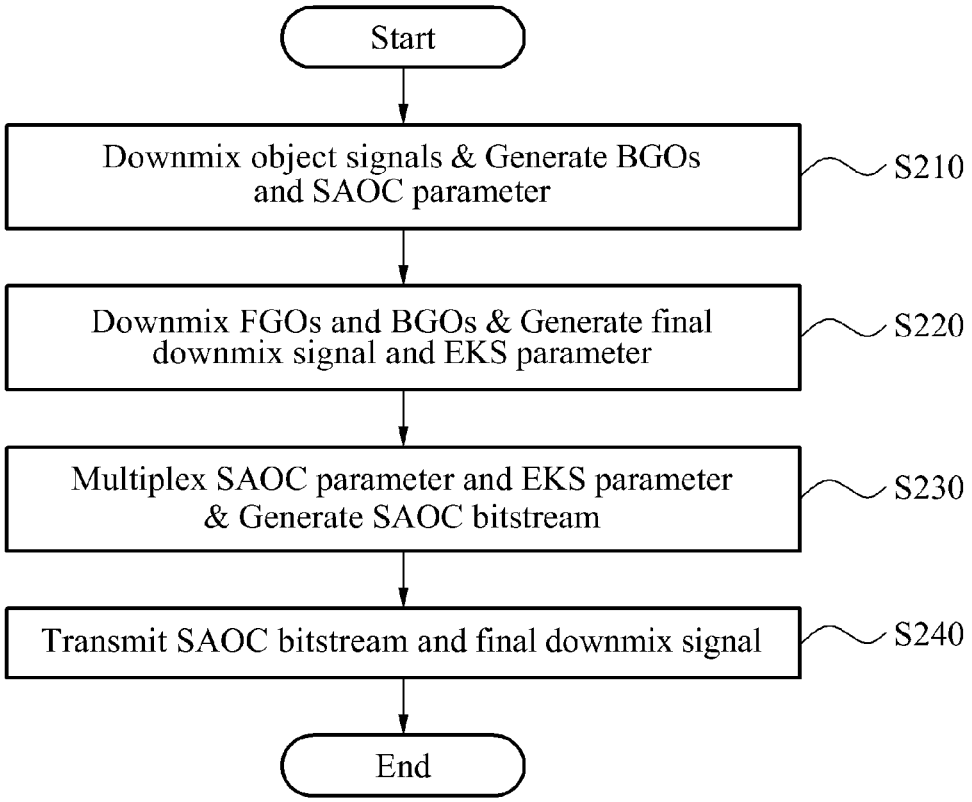
FIG. 2 is a flowchart illustrating a method of encoding a multi-object audio signal according to an embodiment of the present invention.

FIG. 1 is a diagram illustrating a configuration of a multi-object audio signal encoding apparatus 100 according to an embodiment of the present invention. FIG. 2 is a flowchart illustrating a method of encoding a multi-object audio signal according to an embodiment of the present invention.

Referring to FIG. 1, the multi-object audio signal encoding apparatus 100 may include a first encoder 110, a second encoder 120, and a multiplexer 130.

Referring to FIGS. 1 and 2, multi-object audio signals refer to a plurality of input object signals. For example, 'N' input object signals may include 'K' ForeGround Objects (FGOs) and 'N−K' object signals. In other words, the 'N−K' object signals refer to object signals obtained by excluding the 'K' FGOs from the 'N' input object signals. Here, 'N,' and 'K' are constant values.

In FIG. 2, in operation S210, the first encoder 110 may downmix object signals, and may generate BackGround Objects (BGOs) and a Spatial Audio Object Codec (SAOC) parameter. The generated BGOs may be input to the second encoder 120.

For example, 'N−K' object signals obtained by excluding 'K' FGOs from 'N' object signals may be input to the first encoder 110. Here, the SAOC parameter may function as a spatial cue parameter for each of the 'N−K' object signals, and may include energy information and correlation information of the BGOs.

In this example, the first encoder 110 may be defined as a classic mode encoder used to downmix the 'N−K' object signals. The classic mode encoder may use only a spatial cue parameter defined in a Moving Picture Experts Group (MPEG) SAOC standard.

Here, the FGOs refer to object signals where a sound quality is rapidly degraded when being independently played back or where sound is completely removed, among the plurality of input object signals. In other words, the FGOs mean object signals that a listener desires to particularly control.

For example, assuming that a plurality of input object signals are multi-object signals including musical instrument signals and vocal signals, and that a particular control object signal is a vocal signal, when the vocal signals are completely removed from the multi-object signals, a final signal may be obtained as a karaoke signal. In this example, the vocal signals to be completely removed may be defined as FGOs.

In operation S220, the second encoder 120 may downmix the FGOs and the BGOs, and may generate a final downmix signal and an Enhanced Karaoke-Solo (EKS) to parameter. Here, the EKS parameter may be used as a spatial cue parameter for each of the FGOs and each of the BGOs, and may include energy information and correlation information of the final downmix signal, and a residual signal calculated from the final downmix signal and the FGOs.

Additionally, the second encoder 120 may be defined as an EKS mode encoder that is used to downmix the FGOs and the BGOs and to improve a sound quality of the FGOs using a residual signal coding defined in the MPEG SAOC standard.

In operation S230, the multiplexer 130 may multiplex the SAOC parameter and the EKS parameter, and may generate an SAOC bitstream. For example, the multiplexer 130 may receive, as input, the SAOC parameter and the EKS parameter, and may multiplex the SAOC parameter and the EKS parameter into an SAOC standard bitstream.

In operation S240, the multiplexer 130 may transmit the generated SAOC bitstream and the generated final downmix signal to a multi-object audio signal decoding apparatus 300. In other words, the multiplexer 130 may transmit, to the multi-object audio signal decoding apparatus 300, the SAOC bitstream along with the final downmix signal generated by the second encoder 120.

An encoding process for downmixing the FGOs and the BGOs and generating the final downmix signal has been described above. As described with reference to FIGS. 1 and 2, in the multi-object audio signal encoding apparatus 100, the first encoder 110 and the second encoder 120 may be typically operated together, however, a final downmix signal may be generated using only either the FGOs or the BGOs. In other words, the first encoder 110 and the second encoder 120 may be operated selectively based on a classic encoding mode or an EKS encoding mode.

For example, when the multi-object audio signal encoding apparatus 100 is operated in the classic encoding mode, the second encoder 120 and the multiplexer 130 may be deactivated, and may not function. Accordingly, the BGOs generated by the first encoder 110 may be used to generate a final downmix signal, and the BGOs and the SAOC parameter may be transmitted to the multi-object audio signal decoding apparatus 300. Here, the classic encoding mode may be set to limitedly control a volume for each of the 'N' object signals, with respect to 'N' object signals (K=0).

As another example, when the multi-object audio signal encoding apparatus 100 is operated in the EKS encoding mode, the first encoder 110 and the multiplexer 130 may be deactivated, and may not function. Accordingly, the second encoder 120 may downmix 'M' BGOs and 'K' FGOs, and may generate a final downmix signal and an EKS parameter. Here, the EKS parameter may include each spatial parameter calculated from the 'M' BGOs and the 'K' FGOs, and a residual signal calculated from a downmix signal and a FGO.

In the EKS encoding mode, an SAOC bitstream may be generated using the final downmix signal and the EKS parameter generated in the EKS encoding mode, and the generated SAOC bitstream may be transmitted to the multi-object audio signal decoding apparatus 300.

The method of encoding the multi-object audio signal has been described above with reference to FIGS. 1 and 2. Hereinafter, a method of decoding a multi-object audio signal will be described with reference to FIGS. 3 and 4.

Figure 3:
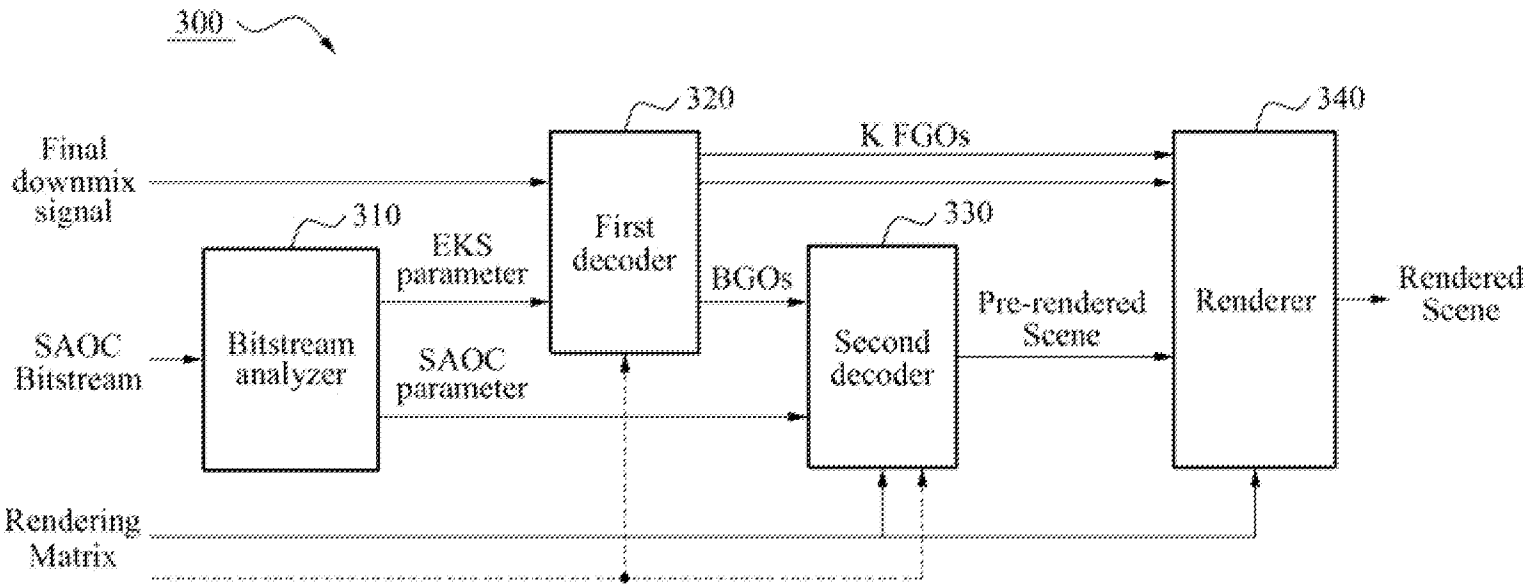
FIG. 3 is a diagram illustrating a configuration of a multi-object audio signal decoding apparatus according to an embodiment of the present invention.
Figure 4:
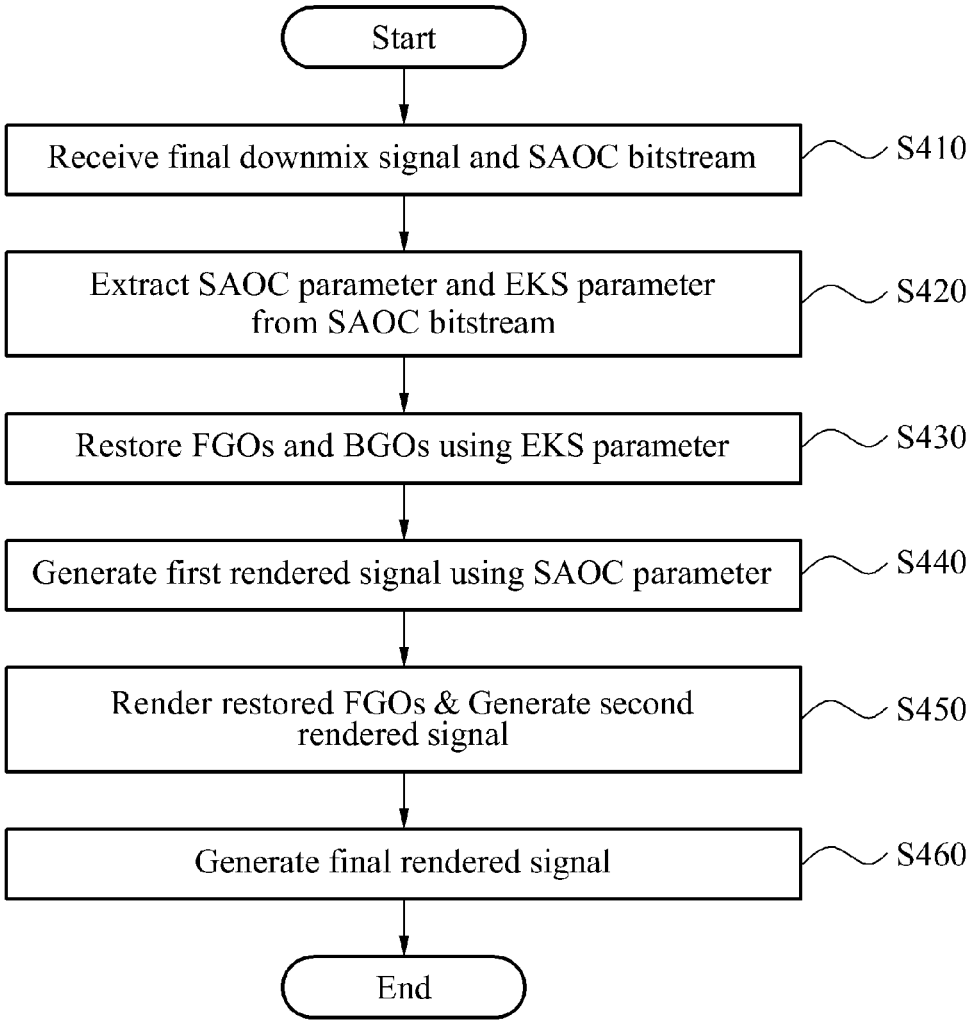
FIG. 4 is a flowchart illustrating a method of decoding a multi-object audio signal according to an embodiment of the present invention.

FIG. 3 is a diagram illustrating a configuration of the multi-object audio signal decoding apparatus 300 according to an embodiment of the present invention. FIG. 4 is a flowchart illustrating a method of decoding a multi-object audio signal according to an embodiment of the present invention.

In FIG. 3, the multi-object audio signal decoding apparatus 300 may include a bitstream analyzer 310, a first decoder 320, a second decoder 330, and a renderer 340.

Referring to FIGS. 3 and 4, in operation S410, the multi-object audio signal decoding apparatus 300 may receive the final downmix signal and the SAOC bitstream from the multi-object audio signal encoding apparatus 100. Here, the final downmix signal may be generated by the second encoder 120. Additionally, the SAOC bitstream may be input to the bitstream analyzer 310, and the final downmix signal may be input to the first decoder 320.

In operation S420, the bitstream analyzer 310 may extract the SAOC parameter and the EKS parameter from the SAOC bitstream. The extracted EKS parameter may be input to the first decoder 320, and the extracted SAOC parameter may be input to the second decoder 330.

For example, the bitstream analyzer 310 may parse the input SAOC bitstream, and may extract the SAOC parameter and the EKS parameter. Here, the SAOC parameter may be used as a spatial cue parameter for each object signal obtained by excluding FGOs from a plurality of input object signals, and the EKS parameter may be used as a spatial cue parameter for each of the FGOs.

In operation S430, the first decoder 320 may restore the FGOs and the BGOs from the final downmix signal using the EKS parameter. Here, the first decoder 320 may be defined as an EKS mode decoder. The restored BGOs may be input to the second decoder 330.

In operation S440, the second decoder 330 may generate a first rendered signal from the BGOs using the SAOC parameter and a rendering matrix that is stored in advance. Here, the first rendered signal may be a pre-rendered scene of FIG. 3.

For example, the second decoder 330 may generate the first rendered signal by adjusting a gain of the BGOs based on a gain value included in the rendering matrix. The generated first rendered signal may be input to the renderer 340.

In operation S450, the renderer 340 may render the FGOs restored by the first decoder 320, and may generate a second rendered signal.

For example, the renderer 340 may generate the second rendered signal by adjusting a gain of the restored FGOs based on the gain value included in the rendering matrix.

In operation S460, the renderer 340 may combine the first rendered signal and the second rendered signal, and may generate a final rendered signal, for example a rendered scene of FIG. 3. The generated final rendered signal may be played back by a sound equipment such as a speaker.

A decoding process for generating the final rendered signal using the restored FGOs and the restored BGOs has been described above. As described above with reference to FIGS. 3 and 4, in the multi-object audio signal decoding apparatus 300, the first decoder 320 and the second decoder 330 may be typically operated together, however, a final downmix signal may be generated using only either the restored FGOs or the restored BGOs. In other words, the first decoder 320 and the second decoder 330 may be operated selectively based on a classic decoding mode or an EKS decoding mode.

For example, when the multi-object audio signal decoding apparatus 300 is operated in the classic decoding mode, the first decoder 320 and the renderer 340 may be deactivated, and may not function. Accordingly, the second decoder 330 may directly receive the final downmix signal transmitted from the multi-object audio signal encoding apparatus 100. Here, the final downmix signal may include the BGOs generated by the first encoder 110.

Additionally, the second decoder 330 may generate a final rendered signal from the BGOs using the SAOC parameter and the rendering matrix. For example, the second decoder 330 may adjust, based on the SAOC parameter, a gain of the BGOs based on the gain value included in the rendering matrix, and may generate the final rendered signal.

As another example, when the multi-object audio signal decoding apparatus 300 is operated in the EKS decoding mode, the second decoder 330 may be deactivated, and may not function. Here, deactivation of the second decoder 330 may indicate that the SAOC bitstream includes only the EKS parameter, not the SAOC parameter. Accordingly, the FGOs and the BGOs restored by the first decoder 320 may be input directly to the renderer 340. Also, the rendering matrix may be input directly to the renderer 340.

Additionally, the renderer 340 may generate the final rendered signal from the restored FGOs and the restored BGOs based on the rendering matrix stored in advance. For example, the renderer 340 may adjust, based on the rendering matrix, a gain of the BGOs based on the gain value included in the rendering matrix, and may generate the final rendered signal.

The method of decoding the multi-object audio signal has been described above with reference to FIGS. 3 and 4. Hereinafter, a method of transcoding a multi-object audio signal will be described with reference to FIGS. 5 and 6.

Figure 5:
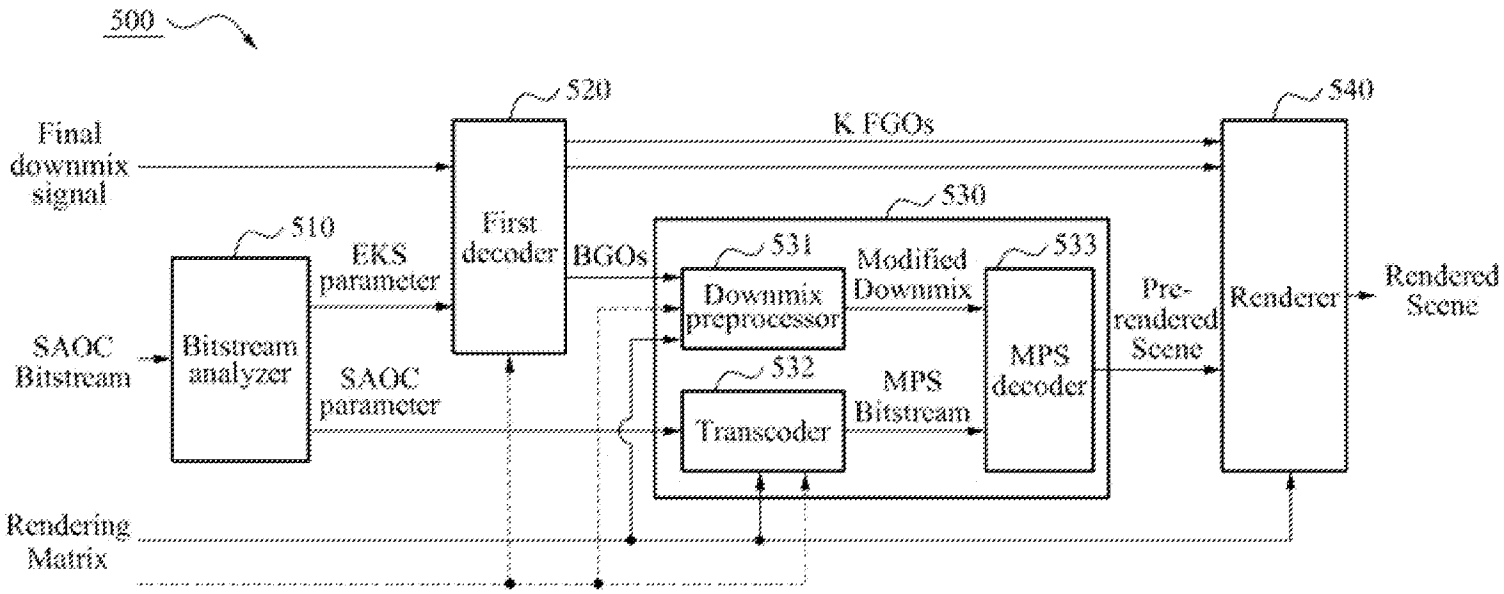
FIG. 5 is a diagram illustrating a configuration of a multi-object audio signal transcoder according to an embodiment of the present invention.
Figure 6:
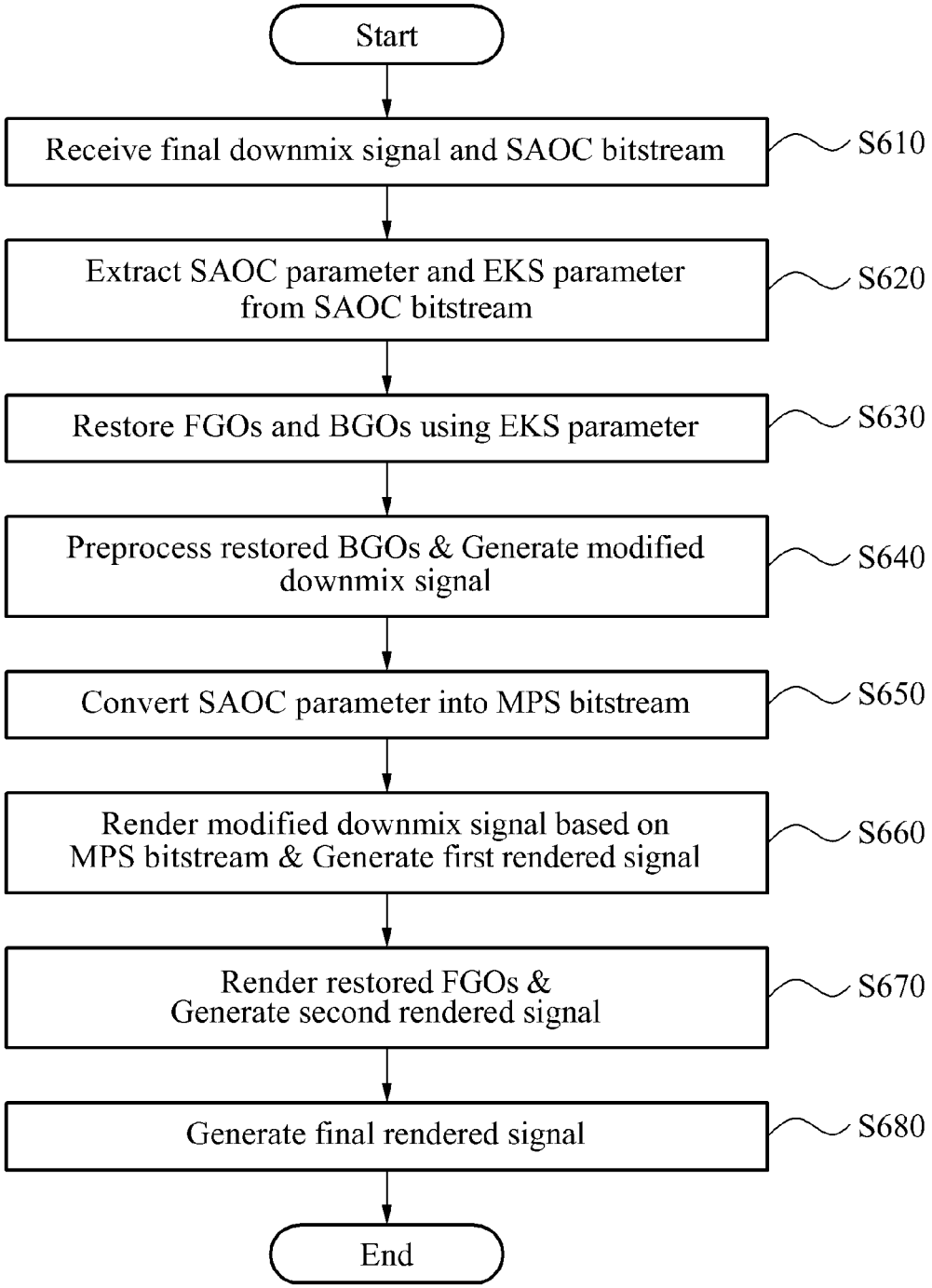
FIG. 6 is a flowchart illustrating a method of transcoding a multi-object audio signal according to an embodiment of the present invention.

FIG. 5 is a diagram illustrating a configuration of a multi-object audio signal transcoder 500 according to an embodiment of the present invention. FIG. 6 is a flowchart illustrating a method of transcoding a multi-object audio signal according to an embodiment of the present invention.

Referring to FIG. 5, the multi-object audio signal transcoder 500, for example an SAOC transcoder, may include a bitstream analyzer 510, a first decoder 520, a second decoder 530, and a renderer 540. The bitstream analyzer 510, the first decoder 520, and the renderer 540 of FIG. 5 may be respectively identical to the bitstream analyzer 310, the first decoder 320, and the renderer 340 of FIG. 3, and operations 5610 through 5630 of FIG. 6 may be respectively performed in the same manner as operations 5410 through 5430 of FIG. 4. Accordingly, further descriptions thereof will be omitted herein. In other words, the second decoder 530 of FIG. 5 may differ in configuration from the second decoder 330 of FIG. 3.

In FIG. 5, the second decoder 530 may include a downmix preprocessor 531, a transcoder 532, and a Moving Pictures Experts Group Surround (MPS) decoder 533.

Referring to FIGS. 5 and 6, in operation S640, the downmix preprocessor 531 may preprocess restored BGOs, and may generate a modified downmix signal. For example, the downmix preprocessor 531 may preprocess the restored BGOs based on a rendering matrix that is stored in advance. Here, the preprocessing operation based on the rendering matrix may be performed in a same manner as a downmix preprocessing operation defined in the MPEG SAOC standard.

In operation S650, the transcoder 532 may convert the SAOC parameter into an MPS bitstream. For example, the transcoder 532 may convert the SAOC parameter into the MPS bitstream, based on the rendering matrix stored in advance. Here, the converting operation may be performed in a same manner as a converting operation defined in the MPEG SAOC standard.

In operation S660, the MPS decoder 533 may render the modified downmix signal based on the converted MPS bitstream, and may generate a first rendered signal, for example, a pre-rendered scene of FIG. 5. The generated first rendered signal may be input to the renderer 540. Here, the MPS decoder 533 may render the modified downmix signal in a multi-channel. In other words, the MPS decoder 533 may generate the first rendered signal of the multi-channel.

In operation S670, the renderer 540 may generate a second rendered signal from restored FGOs, based on the rendering matrix stored in advance. For example, the renderer 540 may adjust a gain of the restored FGOs based on a gain value included in the rendering matrix, and may generate the second rendered signal.

In operation S680, the renderer 540 may combine the generated first rendered signal and the second rendered signal, and may generate a final rendered signal, for example a rendered scene of FIG. 5. Here, the first rendered signal may be the rendered modified downmix signal.

The generated final rendered signal may be played back by a sound equipment such as a speaker.

Here, a frequency/time converting operation may be required to generate the final rendered signal, and may be performed selectively by the MPS decoder 533 and the renderer 540. For example, the MPS decoder 533 may convert the rendered modified downmix signal from a frequency domain to a time domain. As another example, the renderer 540 may convert the restored FGOs from a frequency domain to a time domain.

The method of transcoding the multi-object audio signal to generate the final rendered signal using the restored FGOs and the restored BGOs has been described above with reference to FIGS. 5 and 6.

As described above with reference to FIGS. 5 and 6, in the multi-object audio signal transcoder 500, the first decoder 520 and the second decoder 530 may be typically operated together, however, a final rendered signal may be generated using only either the restored FGOs or the restored BGOs.

In other words, the first decoder 520 and the second decoder 530 may be operated selectively based on a classic decoding mode or an EKS decoding mode. Here, an operation of generating a final rendered signal based on a classic mode and an EKS mode has been described above with reference to FIGS. 3 and 4 and accordingly, further descriptions thereof will be omitted herein.

While in FIGS. 3 and 5, the renderers 340 and 540 render the restored FGOs, the first decoders 320 and 520, instead of the renderers 340 and 540, may render the restored FGOs and may generate a second rendered signal. In other words, the rendering operation described with reference to FIGS. 3 and 5 may be performed in a same manner as a rendering operation defined in an SAOC standard.

For example, referring to dotted lines of FIGS. 3 and 5, the first decoders 320, 520 may adjust the gain of the restored FGOs based on the gain value included in the rendering matrix, and may generate a second rendered signal. Additionally, the renderers 340 and 540 may combine the second rendered signal and the first rendered signal generated by the second decoders 330 and 530, and may generate a final rendered signal. In other words, the rendering matrix may not be input to the renderers 340 and 540.

As another example, during the encoding of the multi-object audio signal as described with reference to FIGS. 1 and 2, the first encoder 110 and the second encoder 120 may sequentially perform functions. When 'K' FGOs exist in 'N' input object signals, a maximum number of FGOs input to the second encoder 120 may be limited to four, or two or less. For example, when mono FGOs are input to the second encoder 120, a maximum number of mono FGOs may be limited to four. As another example, when stereo FGOs are input to the second encoder 120, a maximum number of stereo FGOs may be limited to two, that is, four channels.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

The invention claimed is:

1. An encoding apparatus, comprising:

a first encoder to downmix object signals, and to generate BackGround Objects (BGOs) and a Spatial Audio Object Codec (SAOC) parameter, the object signals being obtained by excluding ForeGround Objects (FGOs) from a plurality of input object signals; and a second encoder to downmix the FGOs and the BGOs, and to generate a final downmix signal and an Enhanced Karaoke-Solo (EKS) parameter.

2. The encoding apparatus of claim 1, further comprising:

a multiplexer to multiplex the SAOC parameter and the EKS parameter and to generate an SAOC bitstream.

3. The encoding apparatus of claim 1, wherein the first encoder and the second encoder are operated selectively based on an EKS encoding mode for controlling the FGOs, and a classic encoding mode for controlling the BGOs.

4. An encoding method, comprising:

downmixing object signals, and generating BackGround Objects (BGOs) and a Spatial Audio Object Codec (SAOC) parameter by a first encoder, the object signals being obtained by excluding ForeGround Objects (FGOs) from a plurality of input object signals; and downmixing the FGOs and the BGOs, and generating a final downmix signal and an Enhanced Karaoke-Solo (EKS) parameter by a second encoder.

5. The encoding method of claim 4, further comprising:

multiplexing the SAOC parameter and the EKS parameter, and generating an SAOC bitstream.

6. A decoding apparatus, comprising:

a bitstream analyzer to extract a Spatial Audio Object Codec (SAOC) parameter and an Enhanced Karaoke-Solo (EKS) parameter from a multiplexed SAOC bitstream;

a first decoder to restore ForeGround Objects (FGOs) and BackGround Objects (BGOs) from a final downmix signal using the EKS parameter;

a second decoder to generate a first rendered signal from the BGOs using the SAOC parameter and a rendering matrix; and a renderer to generate a final rendered signal using the FGOs and the first rendered signal.

7. The decoding apparatus of claim 6, wherein the renderer generates, based on the rendering matrix, the final rendered signal by using the first rendered signal and a second rendered signal that is generated from the FGOs.

8. The decoding apparatus of claim 7, wherein the second decoder generates the first rendered signal by adjusting a gain of BGOs based on a gain value included in the rendering matrix, and wherein the renderer generates a second rendered signal by adjusting a gain of the FGOs based on the gain value included in the rendering matrix.

9. The decoding apparatus of claim 6, wherein the second decoder comprises:

a downmix preprocessor to preprocess the BGOs based on the rendering matrix, and to generate a modified downmix signal;

an SAOC transcoder to convert the SAOC parameter into a Moving Pictures Experts Group Surround (MPS) bitstream based on the rendering matrix; and an MPS decoder to render the modified downmix signal based on the MPS bitstream and to generate the first rendered signal.

10. The decoding apparatus of claim 9, wherein the renderer generates the final rendered signal using the rendered modified downmix signal and the FGOs.

11. The decoding apparatus of claim 6, wherein the first decoder and the second decoder are operated selectively based on an EKS decoding mode for controlling the FGOs, and a classic decoding mode for controlling the BGOs.

12. The decoding apparatus of claim 6, wherein the first decoder renders the restored FGOs based on the rendering matrix, and wherein the renderer combines the rendered FGOs and the rendered BGOs, and generates the final rendered signal.

13. A decoding method, comprising:

extracting a Spatial Audio Object Codec (SAOC) parameter and an Enhanced Karaoke-Solo (EKS) parameter from a multiplexed SAOC bitstream;

restoring ForeGround Objects (FGOs) and BackGround Objects (BGOs) from a final downmix signal using the EKS parameter;

generating a first rendered signal from the BGOs using the SAOC parameter and a rendering matrix; and generating a final rendered signal using the FGOs and the first rendered signal.

14. The decoding method of claim 13, wherein the generating of the final rendered signal comprises generating, based on the rendering matrix, the final rendered signal by using the first rendered signal and a second rendered signal that is generated from the FGOs.

15. The decoding method of claim 14, wherein the generating of the first rendered signal comprises generating the first rendered signal by adjusting a gain of the BGOs based on a gain value included in the rendering matrix, and wherein the generating of the final rendered signal comprises generating the second rendered signal by adjusting a gain of the FGOs based on the gain value included in the rendering matrix.

16. The decoding method of claim 13, wherein the generating of the first rendered signal comprises:

preprocessing the BGOs based on the rendering matrix, and generating a modified downmix signal;

converting the SAOC parameter into a Moving Pictures Experts Group Surround (MPS) bitstream based on the rendering matrix; and rendering the modified downmix signal based on the MPS bitstream and generating the first rendered signal.

17. The decoding method of claim 16, wherein the generating of the final rendered signal comprises generating the final rendered signal using the rendered modified downmix signal and the FGOs.

18. The decoding method of claim 13, further comprising:

rendering the restored FGOs based on the rendering matrix, wherein the generating of the final rendered signal comprises combining the rendered FGOs and the rendered BGOs, and generating the final rendered signal.

19. A decoding apparatus, comprising:

a bitstream analyzer to extract a Spatial Audio Object Codec (SAOC) parameter and an Enhanced Karaoke-Solo (EKS) parameter from a multiplexed SAOC bitstream;

a first decoder to restore ForeGround Objects (FGOs) and BackGround Objects (BGOs) from a final downmix signal using the EKS parameter, and to render the restored FGOs based on a rendering matrix;

a second decoder to render the BGOs using the SAOC parameter and the rendering matrix; and a renderer to combine the rendered FGOs and the rendered BGOs, and to generate a final rendered signal.

20. A decoding method, comprising:

extracting a Spatial Audio Object Codec (SAOC) parameter and an Enhanced Karaoke-Solo (EKS) parameter from a multiplexed SAOC bitstream;

restoring ForeGround Objects (FGOs) and BackGround Objects (BGOs) from a final downmix signal using the EKS parameter;

rendering the restored FGOs based on a rendering matrix;

rendering the BGOs using the SAOC parameter and the rendering matrix; and combining the rendered FGOs and the rendered BGOs and generating a final rendered signal.

* * * * *